US005324612A

United States Patent [19]

Maeda et al.

[11] Patent Number: 5,324,612

[45] Date of Patent: Jun. 28, 1994

[54] TONER FOR ELECTROPHOTOGRAPHY

[75] Inventors: Satoshi Maeda; Yasunari Hotta; Minako Arichi; Yohzo Yamada; Tetsuo Shimomura; Yoshihiro Ikuzawa, all of Ohtsu, Japan

[73] Assignee: Toyo Boseki Kabushiki Kaisha, Osaka, Japan

[21] Appl. No.: 931,586

[22] Filed: Aug. 18, 1992

[30] Foreign Application Priority Data

Oct. 3, 1991 [JP] Japan ..... 3-283726
Oct. 24, 1991 [JP] Japan ..... 3-306854

[51] Int. Cl.[5] ..... G03G 9/00

[52] U.S. Cl. ..... 430/109; 430/137; 430/904

[58] Field of Search ..... 430/109, 110, 137, 904; 528/128

[56] References Cited

U.S. PATENT DOCUMENTS 4,788,122 11/1988 Kawabe et al. .
4,933,252 6/1290 Nishikawa et al. ..... 430/109

*Primary Examiner*—Steve Rosasco
*Attorney, Agent, or Firm*—Leydig, Voit & Mayer, Ltd.

[57] ABSTRACT

A toner for electrophotography which comprises, as a binder resin, a polyester resin obtained from carboxylic acids containing aromatic monomer in a proportion of 80 mol % or more relative to the entire carboxylic acid component, and alcohols containing aliphatic diols having 2 to 4 carbon atoms in a proportion of 70–100 mol % relative to the entire alcohol component and alicyclic alcohols in a proportion of 0–30 mol % relative to the entire alcohol component, and having a specific gravity of 1.3 or more, a glass transition temperature of 58° C. or more, and a number average molecular weight of 1,000–6,000. The toner of the present invention is superior in image characteristics, fixability, storage stability (resistance to blocking), resistance to plasticizer and charge stability. Therefore, even after a long-term storage of a sheet copied using the toner of the present invention, by keeping same in direct contact with a vinyl chloride transparent sheet or an eraser, transfer of coloring materials and attaching of resin onto the vinyl chloride sheet or the eraser do not occur.

15 Claims, No Drawings

TONER FOR ELECTROPHOTOGRAPHY

FIELD OF THE INVENTION

The present invention relates to a toner in use as a developing powder for electrophotographic copier, laser printer, facsimile, etc.

BACKGROUND OF THE INVENTION

In general, an electrophotographic method includes uniform charging of an inorganic photoconductive substance (photosensitive drum) such as selenium, amorphous silicon and zinc oxide, or an organic photoconductive substance (photosensitive drum) such as diazo compound, pigment, etc., which has been in most cases prepared into a drum, irradiation of an image modulated light to form an electrostatic latent image, said image being developed by allowing a powder material to be attracted by static electricity, transferring the powder material on a receiving surface such as paper, film, etc. as necessary, and fixing same by applying pressure, heat, and so on. The electrophotographic method has been widely used for copier, laser printer, facsimile, etc.

The powder for forming an image by developing the electrostatic latent image on the photosensitive drum, which is ultimately transferred onto a receiving surface such as paper or film in the electrophotographic method is referred to as a toner. A toner is usually mixed with a carrier such as glass beads, iron powder, ferrite, etc., and used as a developing powder. As the toner as a developing powder for electrophotography, used are particles prepared by the pulverizing method comprising mixing and kneading of a binder resin with colorants, charge control agents, flowability improvers, pulverization aids, etc., pulverizing the obtained mixture, and classifying the same.

As the toner binder resin, styrene/acrylic copolymers have been mainly used. However, polyester resins have been drawing attention recently in view of their excellent fixability at low temperatures as demanded by the increased speed and coloring of electrophotography.

In particular, colored electrophotography requires gloss on the image surface from the aspect of color reproduction, and polyester resins which afford superior surface gloss by low temperature fixing have been increasingly used.

The polyester resins conventionally used are mainly unsaturated polyester resins obtained by condensation polymerization of aliphatic unsaturated carboxylic acids such as fumalic acid, maleic acid, etc. with diols having bisphenol structure.

The glass transition temperature of the polyester resin depends mainly on number average molecular weight. The unsaturated polyester resin is generally polymerized by the normal pressure method, whereas a high molecular weight polyester resin cannot be produced by the production processes thereof, thus failing to achieve high glass transition temperature. The glass transition temperature of unsaturated polyester resin obtained by conventional methods is about 55° C., which in turn causes poor storage stability of a toner comprising an unsaturated polyester resin as a binder resin, despite its superior low temperature fixing characteristics, as evidenced by the fact that a long-term storage at high temperature results in blocking of the toner.

In case where bisphenol diols are used, plasticizers used in sheets made of vinyl chloride resins and erasers tend to transfer. For this reason, when copied images are kept in a clear file or on a desk mat made of vinyl chloride resins, or an eraser or eraser refuse is left on the images, the plasticizer contained in the vinyl chloride sheet or eraser gives rise to the damaged images and staining of the clear sheet or eraser.

In the case of colored electrophotography, it is required that a toner should possess high transparency from the aspects of reproduction of intermediate colors and penetrability of the sheets for overhead projectors. The use of a dye as a colorant is preferable for increasing transparency of a toner. However, resins comprising bisphenol type diols do not permit sufficient color production by the dye, since they cause marked degradation of color fastness to heat and color fastness to light of the dye, for which reason the colorant is limited to pigments which are poor in transparency. In order to produce transparent toners by using pigments, it is necessary to disperse pigments finely pulverized to the size smaller than the light wavelength in a resin as primary particles, and this process gives rise to various problems while processing.

There has been an attempt to use aromatic polyester resins obtained from aromatic dicarboxylic acids such as terephthalic acid and isophthalic acid, and aliphatic diols such as ethylene glycol and neopentyl glycol as a toner binder, besides the above-mentioned unsaturated polyester resins.

The aromatic polyester resins can be easily made to have high molecular weight, since they are usually polymerized by the reduced pressure method. For this reason, high glass transition temperature of the aromatic polyester resins can be achieved rather easily, and can afford toners with good storage stability.

On the other hand, practical glass transition temperature of about 58° C. or more, preferably 60 ° C. or more, more preferably 63° C. or more requires extremely high number average molecular weight of polyester resin, which in turn raises melt viscosity of the polyester resin, impairing low temperature fixability possessed by the polyester resin.

For the realization of high glass transition temperature while retaining low temperature fixability, there has been proposed introduction of bisphenol type diols as a diol component. When the bisphenol type diols are introduced, both the glass transition temperature of not less than about 58° C. and low temperature fixability can be obtained. In this case, however, the same problems as in the case of the aforementioned unsaturated polyester resin, namely, decrease in color fastness to heat, color fastness to light, and resistance to plasticizer can occur, and a toner for electrophotography having good characteristics cannot be obtained.

SUMMARY OF THE INVENTION

As described in the above, the conventional polyester resins pose problems in that storage stability and low temperature fixing cannot be achieved at the same time, and that a toner for electrophotography which satisfies resistance to plasticizer, transparency, processability, color fastness to heat and color fastness to light cannot be achieved.

An object of the present invention is to provide a toner for electrophotography, which is capable of solving the abovementioned problems, specifically the problem of resistance to plasticizer.

DETAILED DESCRIPTION OF THE INVENTION

The present inventors have conducted intensive studies, and as a result, found that the present invention can accomplish the aforementioned object.

That is, the present invention provides a toner for electrophotography which comprises, as a binder resin, a polyester resin having specific gravity of 1.3 or above, glass transition temperature of not less than 58° C., and number average molecular weight of between 1,000 and 6,000, which is obtained from carboxylic acids containing an aromatic monomer in a proportion of 80 mol % or more relative to the entire carboxylic acid component, and alcohols containing aliphatic dials having 2 to 4 carbon atoms in a proportion of 70–100 mol % relative to the entire alcohol component, and alicyclic alcohols in a proportion of 0–30 mol % relative to the entire alcohol component.

Here, "alcohols containing aliphatic diols having 2 to 4 carbon atoms in a proportion of 70–100 mol % relative to the entire alcohol component, and alicyclic alcohols in a proportion of 0–30 mol % relative to the entire alcohol component" means that the mol % of respective alcohols only need to satisfy each range, and to be within 100 mol % in total of the two. In other words, the total may be less than 100 mol % as long as each mol % is within the above-specified range, in which case the total mol % including other alcohol components needs to be 100 mol %. The same applies when such description appears hereinafter.

The polyester resin of the present invention essentially contains 80 mol % or more of aromatic monomer as a carboxylic acid component. Where the aromatic monomer content is less than 80 mol %, a toner is subject to plasticization, swelling, and melting, or transfer of colorant contained in a toner to vinyl chloride sheets and erasers, due to the plasticizer contained in the vinyl chloride sheets and erasers, giving rise to the degradation of copied images.

Here, the aromatic monomer is an aromatic compound containing at least one of carboxyl groups or their derivatives capable of forming an ester linkage upon reaction with alcohols.

The aromatic monomer includes, for example, aromatic dicarboxylic acids such as terephthalic acid, isophthalic acid, orthophthalic acid, 1,5-naphthalenedicarboxylic acid, 2,6-naphthalenedicarboxylic acid and diphenic acid, aromatic carboxylic acids of trivalent or more such as trimellitic acid, trimesic acid and pyromellitic acid, aromatic hydroxycarboxylic acids such as p-hydroxybenzoic acid and p-(hydroxyethoxy)benzoic acid, aromatic monocarboxylic acids such as benzoic acid, chlorobenzoic acid, bromobenzoic acid, 3-methylbenzoic acid, 4-methylbenzoic acid, t-butylbenzoic acid, naphthalenecarboxylic acid and thiosalicylic acid, and lower alkyl esters thereof.

Of those, preferred are terephthalic acid, isophthalic acid and orthophthalic acid, and they are added at a ratio (terephthalic acid/isophthalic acid + orthophthalic acid) of 90–40/10–60, preferably 85–50/15–50, more preferably 80–60/20–40 on a mol % basis.

Of the aforementioned aromatic monomers, carboxylic acids having naphthalene skeleton can be contained in a proportion of 1–20 mol % relative to the entire carboxylic acid component.

Also, of the aforementioned aromatic monomers, at least one member of aromatic carboxylic acids of trivalent or more, such as trimellitic acid, trimesic acid and pyromellitic acid can be contained in a proportion of 2–8 mol %, preferably 3–6 mol % relative to the entire carboxylic acid component.

Further, of the aforementioned aromatic monomers, benzoic acid having branched alkyl as a substituent can be contained in a proportion of 5–20 mol % relative to the entire carboxylic acid component. As the benzoic acid having branched alkyl as a substituent, preferred is t-butylbenzoic acid.

The carboxylic acid component other than aromatic monomer includes aliphatic dicarboxylic acids such as succinic acid, adipic acid, azelaic acid, sebacic acid and dodecanedicarboxylic acid, aliphatic monocarboxylic acids such as acetic acid, phenyl acetic acid, propionic acid, butyric acid, isobutyric acid, octanecarboxylic acid, lauric acid and stearic acid, unsaturated aliphatic dicarboxylic acids such as fumaric acid, maleic acid and itaconic acid, and alicyclic dicarboxylic acids such as hexahydrophthalic acid and tetrahydrophthalic acid.

It is essential that the polyester resin of the present invention contain, as an alcohol component, aliphatic diols having 2 to 4 carbon atoms in a proportion of 70–100 mol % relative to the entire alcohol component, and alicyclic alcohols in a proportion of 0–30 mol % relative to the entire alcohol component.

Where the aliphatic diols having 2 to 4 carbon atoms are contained in a proportion of less than 70 mol %, color fastness to light and heat may be degraded, and where the alicyclic alcohols are contained in a proportion of more than 30 mol %, specific gravity and resistance to plasticizer may be degraded.

Examples of the aliphatic diols having 2 to 4 carbon atoms include, for example, ethylene glycol, propylene glycol, 1,3-propanediol, 2,3-butanediol, 1,4-butanediol and diethylene glycol.

Examples of the alicyclic alcohols include those having cyclohexane skeleton such as 1,4-cyclohexanediol, 1,4-cyclohexanedimethanol, hydrogenated biphenol, hydrogenated bisphenol A and addition product of hydrogenated bisphenol A with ethylene oxide or propylene oxide, those having tricyclodecane skeleton such as tricyclodecyl methanol, tricyclodecane diol and tricyclodecane dimethanol, and spiroglycol.

As the aliphatic diols having 2 to 4 carbon atoms, preferred are those containing ethylene glycol in a proportion of 0–90 mol % relative to the entire alcohol component and propylene glycol in a proportion of 10–100 mol % relative to the entire alcohol component, or those containing 2,3-butanediol in a proportion of 5–80 mol % relative to the entire alcohol component and ethylene glycol in a proportion of 20–95 mol % relative to the entire alcohol component.

Also preferred are those containing aliphatic diol having 2 to 4 carbon atoms in a proportion of 70–95 mol % relative to the entire alcohol component and alcohols having cyclohexane skeleton as alicyclic alcohols in a proportion of 5–30 mol % relative to the entire alcohol component.

Of the above-mentioned alicyclic alcohols, preferred are tricyclodecyl methanol and tricyclodecane dimethanol having tricyclodecane skeleton, cyclohexanediol, hydrogenated biphenol and hydrogenated bisphenol A having cyclohexane skeleton.

The alcohol component other than those exemplified above includes aliphatic diols having 5 or more carbon atoms such as 1,5-pentanediol, 1,6-hexanediol, neopentyl glycol, dipropylene glycol, 2,2,4-trimethyl-1,3-pentanediol, polyethylene glycol, polypropylene glycol and polytetramethylene glycol, aliphatic alcohols of trivalent or more such as trimethylolethane, trimethylolpropane, glycerin and pentaerythritol, and aliphatic monoalcohols such as octanol, decyl alcohol, dodecyl alcohol, tetradecyl alcohol, hexadecyl alcohol and octadecyl alcohol.

Further, aromatic diols such as paraxylene glycol, methaxylene glycol, orthoxylene glycol, 1,4-phenylene glycol, addition product of 1,4-phenylene glycol with ethylene oxide, bisphenol A, addition product of bisphenol A with ethylene oxide or propylene oxide, aromatic monoalcohols such as benzyl alcohol, α-phenyl ethanol, β-phenyl ethanol, diphenyl methanol and triphenyl methanol, and polyesterpolyols such as lactone polyesterpolyol obtained by ring opening polymerization of lactones such as ε-caprolactone can be used.

While the present invention permits concomitant use of alcohols of trivalent or more along with carboxylic acid of trivalent or more, the object thereof is to widen molecular weight distribution of the polyester resin, and is not to gelatinize the resin. Gelatinization of resin particularly makes it difficult to take out the resin from polyester polymerization apparatuses, and causes marked lowering of productivity. The present invention involves no substantial gelatinization, and concretely speaking, it is preferable that the chloroform insoluble matter is contained in a proportion of not more than 0.5% by weight, more preferably not more than 0.25% by weight.

Also in the present invention, a monofunctional monomer can be introduced into polyester for the purpose of blocking the polar group in the polyester polymer terminal so that the stability in the environment of the toner charge characteristics may be improved.

As the monofunctional monomer, monocarboxylic acids or monoalcohols may be used.

It is essential that the glass transition temperature of the polyester resin in the present invention be 58° C. or more, and preferably 60° C. or more, more preferably 63° C. or more, most preferably 65° C. or more. Where the glass transition temperature is less than 58° C., the toner is subject to blocking during handling or storage, giving rise to a problem in storage stability.

The specific gravity of the polyester resin in the present invention is essentially not less than 1.3, preferably not less than 1.31, more preferably not less than 1.32, most preferably not less than 1.33. A specific gravity of less than 1.3 can cause lowering of resistance to plasticizers.

The number average molecular weight of the polyester resin of the present invention is essentially 1,000–6,000, preferably 2,000–5,000, more preferably 3,000–4,000. Where the number average molecular weight is less than, 1,000, melt viscosity of the polyester resin becomes too small, with the result of poor fixability and lowered storage stability. Where the number average molecular weight exceeds 6,000, melt viscosity becomes too great to the extent that the low temperature fixability which is the characteristic feature of the polyester resin of the present invention cannot be demonstrated.

The melt viscosity of the polyester resin of the present invention is preferably between 1,500 and 40,000 poise at 130° C., preferably between 3,000 and 15,000 poise, more preferably between 3,000 and 10,000 poise.

This melt viscosity range is almost the same as for styrene/acrylic resin which has been so far used as a binder resin for a toner for electrophotography, and enables fixing of polyester color toner and styrene/acrylic black toner by the same fixing machine. Said melt viscosity permits use of a styrene/acrylic black toner having no surface gloss for copying a document part of a text, and a polyester color toner having superior surface gloss for graphic part of a text.

The run-off initiation temperature of the polyester resin of the present invention is preferably 80°–130° C., more preferably 90°–120° C., most preferably 100°–110° C. Where it is less than 80° C., storage stability becomes poor, and where it exceeds 130° C., low temperature fixability can be prevented.

The softening point of the polyester resin of the present invention is preferably 80°–150° C. The toner wherein the softening point of the resin has been set for less than 80° C. tends to show agglomeration during handling and storage, and particularly when stored for a long period, flowability may drastically fall. Where the softening point exceeds 150° C., fixing thereof may be hindered. The need to heat the fixing roll to a high temperature raises restriction on material of the fixing roll and material on which the images are copied.

The melt viscosity, run-off initiation temperature and softening point are determined by Flow Tester CFT-500 (Shimazu Seisakusho, Japan) known as a constant load extrusion capillary rheometer.

The melt viscosity is determined by a flow rate by a constant temperature method at 130° C.

The run-off initiation temperature and softening point are determined from the softening curve by the temperature raising method. The run-off initiation temperature is defined as a temperature when, in a softening curve, a syringe clearly starts falling after a small rise of the syringe due to the thermal expansion of a sample. The softening point is defined as a temperature when the syringe has fallen to the one-second position between the run-off initiation point and the run-off termination point on the run-off curve. The nozzle to be used is optionally selected from those having a diameter of 0.2–3.0 mm, length of 0.5–15.0 mm, and load of from 5 to 50 kg.

The acid value of the polyester resin to be used in the present invention is preferably adjusted to 3 mg KOH/g or below, more preferably 1 mg KOH/g or below, most preferably 0.5 mg KOH/g or below.

It is preferable that the polyester resin to be used in the present invention should not dissolve in a single solvent such as methyl ethyl ketone, toluene and tetrahydrofuran at room temperature, since high solubility in a single solvent can cause lowering of resistance to plasticizer.

The polyester resin to be used in the present invention can be prepared by a method conventionally employed, namely, normal pressure polymerization or reduced pressure polymerization.

A polyester resin having a specific gravity of not less than 1.3, and a glass transition temperature of not less than 58° C. can be obtained by adjusting the kind and the amount of carboxylic acids and alcohols. The number average molecular weight of 1,000–6,000, a melt viscosity at 130° C. of 1500–40,000 poise, and a run-off initiation temperature of 80°–130° C. can be also achieved by adjusting polymerization temperature, polymerization time, and the degree of pressure reduction in case of the reduced pressure polymerization.

In the present invention, aromatic carboxylic acid containing a sulfonic acid metal salt group and/or a sulfonic acid ammonium salt group can be contained as an aromatic monomer in a proportion of 6.0 mol·% at maximum relative to the entire carboxylic acid component, for improving charge stability of the toner. For example, sulfoterephthalic acid, 5-sulfoisophthalic acid, 4-sulfophthalic acid, 5-(4-sulfophenoxy) isophthalic acid, 4-sulfonaphthalene-2,7-dicarboxylic acid, sulfobenzoic acid, and their salts can be used. As the salts, exemplified are the salts of ammonium ion, Li, Na, K, Mg, Ca, Cu and Fe, with preference given to potassium salt and sodium salt of alkali metal salt.

In the present invention, a monomer containing an ionic group can be introduced into polyester resin, whereby the polyester resin can be dispersed in water, and charge stability of the toner can be improved.

Examples of the ionic group are the above-mentioned sulfonic acid metal salt and sulfonic acid ammonium salt, and included besides these are carboxylic acid metal salt, carboxylic acid ammonium salt, anion groups such as sulfuric acid, phosphoric acid, phosphonic acid, phosphinic acid, and their ammonium salts and metal salts, and cationic group such as primary to tertiary amines. These ionic groups are preferably contained upon copolymerization with a polyester or introduction into the terminal of a polymer. These ionic groups may be used solely or in combination of two or more of them.

When introducing a carboxylic acid metal salt or a carboxylic acid ammonium salt, a method wherein a carboxyl group is bound to the polymer terminal by introducing a multivalent carboxylic acid such as trimellitic acid into the system at the end stage of polyester polymerization, followed by neutralization with ammonia, sodium hydroxide, etc. to convert to a carboxylic acid salt can be used.

The above-mentioned carboxylic acid metal salt and carboxylic acid ammonium salt are not counted as the "acid value" referred to in the above, since the acid value means a carboxyl group value which does not include carboxylic acid salts.

These ionic groups are contained in a proportion of 10–1000 m equivalent/1000 g, preferably 20–500 m equivalent/1000 g, more preferably 50–200 m equivalent/1000 g. Where the ionic group is contained in an amount smaller than 10 m equivalent/1000 g relative to the polyester resin, sufficient aqueous dispersion cannot be achieved. On the other hand, where it is greater than 1000 m equivalent/1000 g relative to the polyester resin, the toner is susceptible to moisture, and may be degraded during a long-term storage.

The preferable mode of the toner for electrophotography of the present invention is exemplified by polyester spherical particles having an average particle size, D, of 1–30 μm, wherein 80% by number of the particles have a sphereness (ratio of shorter diameter to longer diameter) of 0.7 or more, and the particles have a sharp particle size distribution with 80% by weight or more of the particles having 0.5D–2.0D.

The polyester spherical particles having such preferable characteristics can be obtained by preparing a polyester emulsion (or polyester dispersion) by aqueous dispersion of an ionic group-containing polyester resin, followed by gradual agglomeration under the plasticizing conditions of polyester microparticles in aqueous dispersion.

The aqueous dispersion of an ionic group-containing polyester resin can be achieved by a method comprising mixing an ionic group-containing polyester resin and a water-soluble organic compound, after which water is added thereto, a method comprising mixing an ionic group-containing polyester resin, a water-soluble organic compound, and water, and heating the mixture, and other methods. A surfactant may be concomitantly used then.

The water-soluble organic compound is exemplified by ethanol, isopropanol, butanol, ethylene glycol, propylene glycol, methyl cellosolve, ethyl cellosolve, butyl cellosolve, acetone, methyl ethyl ketone, tetrahydrofuran and dioxane. The watersoluble organic compound is preferably capable of being removed by azeotropy after aqueous dispersion of an ionic group-containing polyester resin.

An aqueous microdispersion means a microdispersion of an ionic group-containing polyester fine particles in an aqueous medium, as a result of the action of electric bilayer caused by dissociation of the ionic group contained in the polyester, and is generally called an emulsion or a colloidal dispersion. The stability of said microdispersion particles depends on the maximum value $V_T$ of a potential curve obtained from the electrolyte content in the particle surface potential (which is practically ζ potential) dispersion system as described by the D.L.V.O theory. The $V_T$ can be determined by the following formulas.

$$V_T(h) = V_R + V_A = \frac{\epsilon a \phi^2}{2} \ln\{1 + \exp(-\kappa h)\} - \frac{A \cdot a}{12 \cdot h}$$

wherein ε is dielectric constant, a is radius of particle size, Φ is surface potential, h is distance between particles, A is Hamaker constant and 1 κ is the thickness of the electric bilayer $$\kappa = \sqrt{\frac{8\pi n Z^2 e^2}{\epsilon k T}}$$

wherein n is electrolyte concentration, Z is ionic valence, e is elementary electric charge, k is Boltzmann constant, and T is absolute temperature. System of units is CGS e.s.u. system.

When $V_T$ is sufficiently great in comparison with energy kT caused by thermal movement (the product of the Boltzmann constant and absolute temperature), which is called a stable dispersion region, microdispersion particles can stably maintain its dispersion state for a long time. When $V_T$ is at the same level as, or lower than kT, which is called a rapid agglomeration region, microdispersion particles rapidly agglomerate and result in sedimentation. When $V_T$ is located in a region between the stable dispersion region and the rapid agglomeration region, the region is called a gradual agglomeration region.

In the gradual agglomeration region, agglomeration of the particles proceeds very gradually. After a lapse of a sufficiently long time, microdispersion particles ultimately agglomerate and form sedimentation as in the rapid agglomeration region. However, when microdispersion particles have been plasticized in the gradual agglomeration region, a multitude of the thus-obtained agglomerates aggregate and are formed into spheres by surface tension, thus resulting in the growth into new particles having a larger particle size (with greater curvature). $V_T$ as described in the D.L.V.O. theory is in proportion to the particle size, and the particle growth (increase of particle size) when $V_T$ is in the positive region results in the enhanced particle stability. As a result, when the system is led to the gradual agglomeration region with the particles plasticized, the particles gradually grow, reach the stable region, and restabilized. However, stable particles cannot be obtained in the rapid agglomeration region for the reason that in the rapid agglomeration region, the agglomerating speed surpasses the speed of aggregating and forming spheres, and agglomerates of the particles aggregate on the basis of the $V_T$ obtained from the smallest curvature of an incomplete agglomerate among a plurality of agglomerates of particles, thus resulting in disordered growth of dendrite aggregates. Therefore, it is preferable that the particles have been plasticized in this case. The plasticization can be performed by heating to more than the glass transition temperature or softening point of polyester, or by using solvents, swelling agents, etc.

While it is difficult to define the gradual agglomeration region by $V_T$ value, the practical range (the range permitting production of polyester particles in several minutes to several hours to several days) is $3\ kT < V_T < 30\ kT$. The zeta potential of the microdispersion particles is desirably controlled to the range of 20 mV–70 mV, preferably 20 mV–60 mV, more preferably 25 mV–50 mV before the addition of an electrolyte.

The polyester particles can be obtained by a particle growth comprising introduction of microdispersed particles into the gradual agglomeration region by adding an electrolyte to an aqueous microdispersion of an ionic group-containing polyester under the conditions permitting plasticization of said ionic-group containing polyester. At this time, a process of lowering zeta potential may be concurrently employed.

The electrolyte to be used in the present invention includes generally-employed inorganic and organic water-soluble salts such as sodium sulfate, ammonium sulfate, potassium sulfate, magnesium sulfate, sodium phosphate, sodium dihydrogen phosphate, disodiumhydrogen phosphate, ammonium chloride, calcium chloride, cobalt chloride, strontium chloride, caesium chloride, barium chloride, nickel chloride, magnesium chloride, rubidium chloride, sodium chloride, potassium chloride, sodium acetate, ammonium acetate, potassium acetate and sodium benzoate. The concentration of the electrolyte is 0.01–1.0 mol/l, preferably 0.05–0.5 mol/l, more preferably 0.1–0.3 mol/l when a monovalent electrolyte is used. When a multivalent electrolyte is used, the amount to be added may be smaller.

In the present invention, the aforementioned electrolyte may be charged in the system beforehand, or may be added later. Preferably, however, polyester particles with better quality can be obtained by forming an electrolyte after the addition of an electrolyte precursor.

The electrolyte precursor is exemplified by, for example, salts which are slightly soluble at low temperature but easily dissolved at high temperature, and compounds which are decomposed by pH, temperature, pressure, irradiation of light, etc. and become electrolytes. In the present invention, ester compounds of aminoalcohols and carboxylic acids can be preferably used as the electrolyte precursor. The ester compound is water-soluble since it has an amino group, and an aqueous solution thereof is alkaline. When said alkaline aqueous solution is heated, an ester linkage is hydrolyzed to give a salt of aminoalcohol and a salt of carboxylic acid. The amino group in effect functions as a primary to tertiary ammonium group.

The aminoalcohols preferably used in the present invention are aminoethanol, 1,3-aminopropanol, 1,4-aminobutanol, dimethylaminoethanol, 1,3-dimethylaminopropanol, diethylaminoethanol, diethylaminopropanol, etc. As the carboxylic acid, usable are benzoic acid and its derivatives, naphthalenecarboxylic acid and its derivatives, salicylic acid, thiosalicylic acid, phenyl acetic acid, acetic acid, propionic acid, butyric acid, octanoic acid, decanoic acid, dodecanoic acid, lauric acid, stearic acid, acrylic acid, methacrylic acid, and so on. In the present invention, esters of these aminoalcohols and carboxylic acids in optional combinations can be preferably used as an electrolyte precursor.

The method for coloring the polyester resin in the present invention is subject to no particular limitation, and known and marketed dyes, pigments, carbon blacks, etc. may be used solely or in combination as necessary.

The toner for electrophotography of the present invention has good color fastness to light even when colored with dyes, and in view of spectral transmission characteristics, the use of dyes superior in transparency, hue and chroma is more preferable than using pigments.

When a dye is used for coloring, azo, pyridone, pyridone azo, nitro, quinoline, quinophthalone, and methine-type dyes are preferably used for yellow coloring; anthraquinone, azo, xanthene-type dyes are preferably used for magenta coloring; and phthalocyanine, anthraquinone-type dyes are preferably used for cyan coloring.

It is preferable to use dyes insoluble in water at room temperature, and disperse dyes and oil-soluble dyes are preferably used. Dyes marketed as disperse dyes for dyeing fabric products may be used directly, or if such marketed dyes are not available, dyes may be prepared by mixing a dye material (conc. cake), a dispersant, and an aqueous medium by a ball mill, a sand mill, a shaker, etc., followed by fine pulverization and fine dispersion. As the dispersant, there may be mentioned condensate of naphthaline sulfonate, polystyrene sulfonate, and copolymer of styrene sulfonate and acrylic acid.

When a pigment is used for coloring, benzidine and azo-type pigments are preferably used for yellow coloring; azo lake, rhodamine lake and quinacridone-type pigments are preferably used for magenta coloring; and phthalocyanine-type pigments are preferably used for cyan coloring.

Carbon black may be used for preparing a black toner. As the carbon black, exemplified are thermal black, acetylene black, channel black, furnace black, and lamp black.

A charge control agent may be contained in the toner for electrophotography of the present invention so as to achieve a predetermined charging. Also, a flowability improver such as alumina fine particles and silica fine particles may be added. Further, the toner of the present invention may contain magnetic materials such as iron, cobalt, nickel, alloys containing those, and ferrite.

The method for producing the toner for electrophotography of the present invention is not subject to any particular limitation, and the toner can be produced by mixing and kneading a polyester resin as a binder resin with colorants, charge control agents, flowability improvers, pulverization aids, etc, followed by pulverizing and classifying.

In order to obtain the aforementioned aqueous dispersion, the wet method comprising an aqueous dispersion of the additives, mixing and stirring same with aqueous dispersion of polyester resin particles, and spray drying may be used.

When an ionic group is contained in the polyester resin, high temperature dyeing using disperse dyes is attainable, due to the stable dispersion of the particles in water by the action of the ionic group, and high concentration dyeing can be performed while retaining the particle state.

The polyester resin to be used in the present invention can afford low melt viscosity at high temperature while retaining a relatively high glass transition temperature. Due to a low affinity with a plasticizer contained in vinyl chloride resin and eraser, transfer of the plasticizer to polyester resin is less. In addition, said polyester resin possesses a certain degree of crystallinity, and less coloring material in the resin transfers, thereby bleeding of the coloring material can be inhibited.

Due to the aforementioned characteristics, the toner for electrophotography of the present invention is superior in image characteristics, fixability, storage stability (resistance to blocking), resistance to plasticizer, and charge stability. Therefore, even after a long-term storage of a sheet which was copied with the use of the electrophotography toner of the present invention, during which the sheet was kept in direct contact with a vinyl chloride transparent sheet or an eraser, transfer of coloring materials and attaching of the resin onto the vinyl chloride sheet or the eraser do not occur.

Since the polyester resin to be used in the present invention is superior in color production by coloring and has high stability to coloring materials, it exhibits high color fastness to light. Since the toner of the present invention is superior in transparency, it shows fine color presentation of primary colors. In addition, the toner of the present invention is superior in color mixing characteristics when layered on other colors, and is particularly superior in reproduction of intermediate colors.

When an image is formed on a transparent film and observed through an overhead projector, etc., the color of the transferred image is greatly affected by the smoothness of the image surface besides transparency of the toner itself. When the toner of the present invention is used, extremely clear color can be reproduced, since the toner itself has a high transparency, and the image surface is highly smooth.

The present invention is hereinafter described in detail by illustrating examples, to which the present invention is not limited.

SYNTHESIS OF POLYESTER RESIN

In an autoclave equipped with a thermometer and a stirrer, dimethylterephthalate (130 parts by weight), dimethyl isophthalate (56 parts by weight), trimellitic anhydride (8 parts by weight), ethylene glycol (159 parts by weight), tricyclodecane dimethanol (30 parts by weight), and tetrabutoxytitanate (0.1 part by weight) were charged, and the mixture was heated at 180°-230° C. for 120 minutes for transesterification. Thereafter, the reaction system was heated to 240° C., the pressure of the system was adjusted to 1-10 mmHg, and the reaction was carried out for 60 minutes to give a polyester copolymer (A01).

As shown in Table 1, the same polymerization as above was conducted using various materials to give polyester resins (A02)-(A20).

In an autoclave equipped with a thermometer and a stirrer, an addition product of bisphenol A with propyleneoxide (70 parts by weight), maleic anhydride (19.6 parts by weight), and hydroquinone (0.2 part by weight) were charged, and a nitrogen gas was introduced into the reaction system to keep the system inert. Dibutyltin oxide (0.05 part by weight) was added thereto and allowed to react at 200° C. to give a polyester resin (A21).

The composition, glass transition temperature, specific gravity, molecular weight, acid value, melt viscosity, run-off initiation temperature, and softening point of the obtained copolymerized polyester resins (A01-)-(A21) are summarized in Table 1. The composition of the polyester was determined by NMR analysis, glass transition temperature was determined by DSC, specific gravity was determined by sink-and-float analysis, and molecular weight was measured by GPC. Melt viscosity was measured by the fixed temperature method using a flow tester CFT-500 (produced by Shimazu Seisakusho, Japan) at 130° C., under the conditions of 10 Kg/cm$^2$ load, 1 mm nozzle diameter, and 10 mm nozzle length. The run-off initiation temperature and softening point were determined by the above-mentioned flow tester CFT-500 under the conditions of a temperature raising rate of 3° C./min., 10 Kg/cm$^2$ load, 1.0 mm nozzle diameter, and 10 mm nozzle length.

TABLE 1

| Polyester resin | | | | | | | | |
|---|---|---|---|---|---|---|---|---|
| | | Polyester resin Examples | | | | | | |
| | | A01 | A02 | A03 | A04 | A05 | A06 | A07 |
| Carboxylic acids (mol %) | | | | | | | | |
| monocarboxylic acid | TBBA | — | — | 10 | — | — | 10 | — |
| dicarboxylic acid | NDC | — | — | — | — | — | — | — |
| | TPA | 67 | 66 | 60 | 66 | 66 | 56 | 70 |
| | IPA | 29 | 28 | 25 | 28 | 28 | 30 | 30 |
| | SIP | — | 2 | 2 | 2 | 2 | — | — |
| | MA | — | — | — | — | — | — | — |
| tricarboxylic acid | TMA | 4 | 4 | 3 | — | 4 | 4 | — |
| tetracarboxylic acid | PMA | — | — | — | 4 | — | | |
| monoalcohol | TCDM | — | — | — | 10 | — | — | — |
| Alcohols (mol %) | | | | | | | | |
| dialcohol | EG | 85 | 85 | 85 | 85 | 80 | 60 | 25 |
| | PG | — | — | — | — | 20 | 40 | 75 |
| | BD | — | — | — | — | — | — | — |
| | NPG | — | — | — | — | — | — | — |

TABLE 1-continued

| | | Polyester resin | | | | | | |
|---|---|---|---|---|---|---|---|---|
| | CHD | — | — | — | — | — | — | — |
| | HBPA | — | — | — | — | — | — | — |
| | HBP | — | — | — | — | — | — | — |
| | TCDD | 15 | 15 | 15 | 5 | — | — | — |
| | BPP | — | — | — | — | — | — | — |
| Tg [°C.] | | 64 | 64 | 63 | 65 | 58 | 61 | 64 |
| specific gravity | | 1.339 | 1.340 | 1.338 | 1.339 | 1.348 | 1.322 | 1.305 |
| number average mol. weight | | 2700 | 2800 | 2600 | 2800 | 3000 | 2800 | 3200 |
| weight average mol. weight | | 14000 | 15000 | 12000 | 16000 | 13500 | 13000 | 4800 |
| acid value [mgKOH/g] | | 0.4 | 0.9 | 0.6 | 0.5 | 0.4 | 0.3 | 0.4 |
| melt viscosity [poise] | | 12000 | 17000 | 13000 | 16500 | 9300 | 9300 | 14000 |
| run-off initiation temp. [°C.] | | 104 | 106 | 105 | 103 | 98 | 101 | 103 |
| softening point [°C.] | | 112 | 115 | 115 | 113 | 106 | 110 | 112 |

| | | Polyester resin Examples | | | | | | |
|---|---|---|---|---|---|---|---|---|
| | | A08 | A09 | A10 | A11 | A12 | A13 | A14 |
| Carboxylic acids (mol %) | | | | | | | | |
| monocarboxylic acid | TBBA | — | — | 10 | — | 10 | — | 10 |
| dicarboxylic acid | NDC | — | — | — | — | — | — | — |
| | TPA | 67 | 69 | 60 | 70 | 60 | 70 | 60 |
| | IPA | 29 | 30 | 24 | 30 | 24 | 30 | 24 |
| | SIP | — | 1 | 2 | — | 2 | — | 2 |
| | MA | — | — | — | — | — | — | — |
| tricarboxylic acid | TMA | 4 | — | 4 | — | 4 | — | 4 |
| tetracarboxylic acid | PMA | — | — | — | — | — | — | — |
| monoalcohol | TCDM | — | — | — | — | — | — | — |
| Alcohols (mol %) | | | | | | | | |
| dialcohol | EG | 80 | 80 | 80 | 80 | 80 | 80 | 80 |
| | PG | — | — | — | — | — | — | — |
| | BD | 20 | — | — | — | — | — | — |
| | NPG | — | — | — | — | — | — | — |
| | CHD | — | 20 | 20 | — | — | — | — |
| | HBPA | — | — | — | 20 | 20 | — | — |
| | HBP | — | — | — | — | — | 20 | 20 |
| | TCDD | — | — | — | — | — | — | — |
| | BPP | — | — | — | — | — | — | — |
| Tg [°C.] | | 63 | 62 | 63 | 63 | 64 | 64 | 63 |
| specific gravity | | 1.345 | 1.325 | 1.326 | 1.322 | 1.321 | 1.331 | 1.328 |
| number average mol. weight | | 2500 | 2800 | 2700 | 2500 | 3100 | 3000 | 2800 |
| weight average mol. weight | | 12000 | 15000 | 11000 | 3900 | 13000 | 4800 | 13500 |
| acid value [mgKOH/g] | | 0.4 | 0.9 | 0.4 | 0.3 | 0.3 | 0.2 | 0.4 |
| melt viscosity [poise] | | 12000 | 11000 | 9800 | 8200 | 11000 | 12500 | 10000 |
| run-off initiation temp. [°C.] | | 102 | 101 | 102 | 103 | 102 | 102 | 104 |
| softening point [°C.] | | 112 | 110 | 110 | 111 | 109 | 110 | 114 |

| | | Polyester resin | | | | | | |
|---|---|---|---|---|---|---|---|---|
| | | Examples | | | Comparative Examples | | | |
| | | A15 | A16 | A17 | A18 | A19 | A20 | A21 |
| Carboxylic acids (mol %) | | | | | | | | |
| monocarboxylic acid | TBBA | — | — | 10 | — | 10 | — | — |
| dicarboxylic acid | NDC | 5 | 10 | 10 | — | — | — | — |
| | TPA | 55 | 55 | 50 | 50 | 60 | 70 | — |
| | IPA | 36 | 35 | 24 | 50 | 24 | 30 | — |
| | SIP | — | — | 2 | — | 2 | — | — |
| | MA | — | — | — | — | — | — | 100 |
| tricarboxylic acid | TMA | 4 | — | 4 | — | 4 | 4 | — |
| tetracarboxylic acid | PMA | — | — | — | — | — | — | — |
| monoalcohol | TCDM | — | — | — | — | — | — | — |
| Alcohols (mol %) | | | | | | | | |
| dialcohol | EG | 100 | 100 | 100 | 40 | 50 | 40 | — |
| | PG | — | — | — | — | — | — | — |
| | BD | — | — | — | — | — | — | — |
| | NPG | — | — | — | 40 | — | — | — |
| | CHD | — | — | — | — | — | 30 | — |
| | HBPA | — | — | — | — | — | — | — |
| | HBP | — | — | — | — | — | — | — |
| | TCDD | — | — | — | 20 | — | — | — |
| | BPP | — | — | — | — | 50 | 30 | 100 |
| Tg [°C.] | | 60 | 64 | 65 | 63 | 64 | 67 | 54 |
| specific gravity | | 1.360 | 1.356 | 1.355 | 1.284 | 1.275 | 1.263 | 1.244 |
| number average mol. weight | | 2500 | 2700 | 2400 | 3300 | 3100 | 3000 | 2200 |
| weight average mol. weight | | 12000 | 4200 | 11000 | 4500 | 14000 | 4500 | 3500 |
| acid value [mgKOH/g] | | 0.4 | 0.4 | 0.3 | 0.5 | 0.4 | 0.4 | 15.0 |
| melt viscosity [poise] | | 10500 | 10000 | 9500 | 8500 | 12000 | 13000 | 2500 |
| run-off initiation temp. [°C.] | | 104 | 103 | 105 | 103 | 104 | 108 | 89 |
| softening point [°C.] | | 111 | 111 | 112 | 110 | 112 | 115 | 98 |

In Table 1, TBBA is t-butylbenzoic acid, NDC is 1,5-naphthalenedicarboxylic acid, TPA is terephthalic acid, IPA is isophthalic acid, SIP is sodium sulfoisophthalic acid, MA is maleic acid, TMA is trimellitic acid, PMA is pyrromellitic acid, TCDM is tricyclodecyl methanol, EG is ethylene glycol, PG is propylene glycol, BD is 2,3-butanediol, NPG is neopentyl glycol, CHD is cyclohexanediol, HBPA is hydrogenated bisphenol A, HBP is hydrogenated biphenol, TCDD is tricyclodecane dimethanol, BPP is an addition product of bisphenol A with propylene oxide (average molecular weight 400), and Tg is glass transition temperature.

PREPARATION OF TONER 1

Pigment/Pulverization.Classification

Phthalocyanine-type cyan pigment (C.I. PIGMENT BLUE 15, 4 parts by weight) was added to polyester resin (A01, 96 parts by weight), and molten-kneaded by an extruder. The kneading temperature was 180° C. Then the mixture was roughly pulverized by a chopper mill, finely pulverized by an ultrasonic jet mill, and particles having a diameter of not more than 5 μm and not less than 15 μm were removed by dry classification. The obtained finely pulverized particles (100 parts by weight) were mixed with silica fine powder (trade name, Aerosil, 2 parts by weight) by a Henschel mixer to give a cyan toner (CP01) having an average particle size of 9.8 μm.

In the same manner as above but using various polyester resins, the toners as shown in Table 2 were obtained. The toners shown in Table 2 were obtained by using quinacridone-type magenta pigment (C.I. PIGMENT RED 122), benzidine-type yellow pigment (C.I. PIGMENT YELLOW 17) and carbon black (PRINTEX 150T [produced by Degussa]).

TABLE 2

Experimental toner (pigment) evaluation results

| Toner | Resin | Colorant C.I. No. | Blocking | Chromaticity coordinates [CUEKAB1976] L* | a* | b* | resistance to plasticizer |
|---|---|---|---|---|---|---|---|
| (YP01) | (A01) | Pig. Y. 17 | None | 92 | −12 | −89 | rank 4 |
| (MP01) | | Pig. R. 122 | None | 52 | 62 | −15 | rank 4 |
| (CP01) | | Pig. B. 15 | None | 55 | −14 | −41 | rank 5 |
| (KP01) | | carbon black | None | 30 | 0 | 0 | rank 4 |
| (YP02) | (A02) | Pig. Y. 17 | None | 91 | −12 | −89 | rank 4 |
| (MP02) | | Pig. R. 122 | None | 53 | 62 | −15 | rank 5 |
| (CP02) | | Pig. B. 15 | None | 55 | −14 | −41 | rank 4 |
| (KP02) | | carbon black | None | 30 | 0 | 0 | rank 4 |
| (YP03) | (A03) | Pig. Y. 17 | None | 92 | −12 | −89 | rank 5 |
| (MP03) | | Pig. R. 122 | None | 53 | 62 | −17 | rank 5 |
| (CP03) | | Pig. B. 15 | None | 53 | −14 | −41 | rank 5 |
| (KP03) | | carbon black | None | 30 | 0 | 0 | rank 5 |
| (YP03) | (A04) | Pig. Y. 17 | None | 91 | −12 | −89 | rank 5 |
| (MP03) | | Pig. R. 122 | None | 54 | 62 | −17 | rank 4 |
| (CP03) | | Pig. B. 15 | None | 52 | −12 | −41 | rank 4 |
| (KP03) | | carbon black | None | 31 | 0 | 0 | rank 4 |
| (YP07) | (A07) | Pig. Y. 17 | None | 91 | −12 | −89 | rank 5 |
| (MP07) | | Pig. R. 122 | None | 53 | 62 | −16 | rank 5 |
| (CP07) | | Pig. B. 15 | None | 54 | −12 | −41 | rank 5 |
| (KP07) | | carbon black | None | 30 | 0 | 0 | rank 4 |
| (YP08) | (A08) | Pig. Y. 17 | None | 89 | −10 | −90 | rank 5 |
| (MP08) | | Pig. R. 122 | None | 51 | 62 | −15 | rank 4 |
| (CP08) | | Pig. B. 15 | None | 54 | −14 | −40 | rank 4 |
| (KP08) | | carbon black | None | 30 | 0 | 0 | rank 5 |
| (YP09) | (A09) | Pig. Y. 17 | None | 90 | −12 | −90 | rank 5 |
| (MP09) | | Pig. R. 122 | None | 52 | 62 | −15 | rank 4 |
| (CP09) | | Pig. B. 15 | None | 55 | −14 | −39 | rank 4 |
| (KP09) | | carbon black | None | 30 | 0 | 0 | rank 4 |
| (YP11) | (A11) | Pig. Y. 17 | None | 90 | −12 | −89 | rank 4 |
| (MP11) | | Pig. R. 122 | None | 52 | 62 | −15 | rank 4 |
| (CP11) | | Pig. B. 15 | None | 55 | −15 | −40 | rank 4 |
| (KP11) | | carbon black | None | 30 | 0 | 0 | rank 4 |
| (YP12) | (A12) | Pig. Y. 17 | None | 91 | −13 | −89 | rank 4 |
| (MP12) | | Pig. R. 122 | None | 52 | 60 | −15 | rank 4 |
| (CP12) | | Pig. B. 15 | None | 54 | −14 | −40 | rank 4 |
| (KP12) | | carbon black | None | 30 | 0 | 0 | rank 4 |
| (YP13) | (A13) | Pig. Y. 17 | None | 92 | −10 | −89 | rank 4 |
| (MP13) | | Pig. R. 122 | None | 52 | 62 | −15 | rank 4 |
| (CP13) | | Pig. B. 15 | None | 54 | −14 | −41 | rank 4 |
| (KP13) | | carbon black | None | 31 | 0 | 0 | rank 4 |
| (YP15) | (A15) | Pig. Y. 17 | None | 92 | −12 | −88 | rank 5 |
| (MP15) | | Pig. R. 122 | None | 52 | 60 | −15 | rank 5 |
| (CP15) | | Pig. B. 15 | None | 55 | −14 | −41 | rank 5 |
| (KP15) | | carbon black | None | 30 | 0 | 0 | rank 5 |
| (YP16) | (A16) | Pig. Y. 17 | None | 90 | −12 | −88 | rank 5 |
| (MP16) | | Pig. R. 122 | None | 52 | 60 | −15 | rank 5 |
| (CP16) | | Pig. B. 15 | None | 55 | −14 | −41 | rank 5 |
| (KP16) | | carbon black | None | 30 | 0 | 0 | rank 5 |
| (YP17) | (A17) | Pig. Y. 17 | None | 91 | −12 | −89 | rank 5 |
| (MP17) | | Pig. R. 122 | None | 52 | 62 | −15 | rank 5 |
| (CP17) | | Pig. B. 15 | None | 55 | −14 | −41 | rank 5 |
| (KP17) | | carbon black | None | 30 | 0 | 0 | rank 5 |
| (YP18) | (A18) | Pig. Y. 17 | None | 92 | −12 | −89 | rank 2 |
| (MP18) | | Pig. R. 122 | None | 52 | 61 | −15 | rank 2 |

TABLE 2-continued

| Toner | Resin | Colorant C.I. No. | Blocking | Chromaticity coordinates [CUEKAB1976] L* | a* | b* | resistance to plasticizer |
|---|---|---|---|---|---|---|---|
| | | Experimental toner (pigment) evaluation results | | | | | |
| (CP18) | | Pig. B. 15 | None | 55 | −14 | −41 | rank 2 |
| (KP18) | | carbon black | None | 30 | 0 | 0 | rank 2 |
| (YP19) | (A19) | Pig. Y. 17 | None | 92 | −12 | −88 | rank 1 |
| (MP19) | | Pig. R. 122 | None | 54 | 62 | −15 | rank 1 |
| (CP19) | | Pig. B. 15 | None | 55 | −14 | −41 | rank 1 |
| (KP19) | | carbon black | None | 31 | 0 | 0 | rank 1 |
| (YP20) | (A20) | Pig. Y. 17 | None | 90 | −11 | −89 | rank 1 |
| (MP20) | | Pig. R. 122 | None | 53 | 61 | −16 | rank 1 |
| (CP20) | | Pig. B. 15 | None | 55 | −13 | −40 | rank 1 |
| (KP20) | | carbon black | None | 30 | 0 | 0 | rank 1 |
| (YP21) | (A21) | Pig. Y. 17 | occured | 91 | −11 | −89 | rank 1 |
| (MP21) | | Pig. R. 122 | occured | 53 | 61 | −16 | rank 1 |
| (CP21) | | Pig. B. 15 | occured | 55 | −14 | −39 | rank 1 |
| (KP21) | | carbon black | occured | 31 | 0 | 0 | rank 1 |

Pig. Y. 17: C.I. PIGMENT YELLOW 17
Pig. R. 122: C.I. PIGMENT RED 122
Pig. B. 15: C.I. PIGMENT BLUE 15
carbon black: PRINTEX 150T [Degussa]

PREPARATION OF TONER 2

Dye/Pulverization.Classification

Anthraquinone-type cyan dye (C.I. DISPERSE BLUE 60, 3 parts by weight) was added to polyester resin (A01, 97 parts by weight), and molten-kneaded in an extruder. The kneading temperature was 180° C. Then the mixture was roughly pulverized by a chopper mill, finely pulverized by a supersonic speed jet mill, and particles having a diameter of not more than 5 μm and not less than 15 μm were removed by dry classification. The obtained finely pulverized particles (100 parts by weight) were mixed with silica fine powder (trade name, Aerosil, 2 parts by weight) by a Henschel mixer to give a cyan toner (CP01) having an average particle size of 9.8 μm.

In the same manner as above but using various polyester resins, the toners as shown in Table 3 were obtained. The toners shown in Table 3 were obtained by using a magenta dye which is a 2:1 mixture of anthraquinone-type red dye (C.I. DISPERSE RED 92) and anthraquinone-type violet dye (C.I. DISPERSE VIOLET 26), nitro-type yellow dye (C.I. DISPERSE YELLOW 42), and diazo-type black dye (C.I. SOLVENT BLACK 3).

TABLE 3

| Toner | Resin | Colorant C.I. No. | Blocking | Chromaticity coordinates [CUEKAB1976] L* | a* | b* | resistance to plasticizer |
|---|---|---|---|---|---|---|---|
| | | Experimental toner (dye) evaluation results | | | | | |
| (YD01) | (A01) | Disp. Y. 42 | None | 90 | −13 | −91 | rank 4 |
| (MD01) | | D. R92/V26 | None | 55 | 61 | −17 | rank 4 |
| (CD01) | | Disp. B. 60 | None | 53 | −10 | −42 | rank 5 |
| (KD01) | | Solv. BK. 3 | None | 29 | 0 | −2 | rank 4 |
| (YD05) | (A05) | Disp. Y. 42 | None | 90 | −12 | −92 | rank 5 |
| (MD05) | | D. R92/V26 | None | 55 | 61 | −18 | rank 5 |
| (CD05) | | Disp. B. 60 | None | 55 | −12 | −41 | rank 5 |
| (KD05) | | Solv. BK. 3 | None | 29 | 0 | −2 | rank 5 |
| (YD08) | (A08) | Disp. Y. 42 | None | 90 | −12 | −92 | rank 5 |
| (MD08) | | D. R92/V26 | None | 54 | 61 | −16 | rank 4 |
| (CD08) | | Disp. B. 60 | None | 53 | −10 | −42 | rank 5 |
| (KD08) | | Solv. BK. 3 | None | 30 | 0 | −1 | rank 4 |
| (YD09) | (A09) | Disp. Y. 42 | None | 89 | −11 | −91 | rank 5 |
| (MD09) | | D. R92/V26 | None | 54 | 61 | −17 | rank 4 |
| (CD09) | | Disp. B. 60 | None | 52 | −10 | −42 | rank 5 |
| (KD09) | | Solv. BK. 3 | None | 30 | 0 | −2 | rank 4 |
| (YD10) | (A10) | Disp. Y. 42 | None | 90 | −12 | −93 | rank 5 |
| (MD10) | | D. R92/V26 | None | 54 | 61 | −17 | rank 5 |
| (CD10) | | Disp. B. 60 | None | 52 | −10 | −42 | rank 5 |
| (KD10) | | Solv. BK. 3 | None | 29 | 0 | −1 | rank 4 |
| (YD12) | (A12) | Disp. Y. 42 | None | 90 | −13 | −93 | rank 5 |
| (MD12) | | D. R92/V26 | None | 55 | 61 | −16 | rank 4 |
| (CD12) | | Disp. B. 60 | None | 52 | −10 | −42 | rank 4 |
| (KD12) | | Solv. BK. 3 | None | 30 | 0 | −1 | rank 4 |
| (YD14) | (A14) | Disp. Y. 42 | None | 91 | −13 | −93 | rank 4 |
| (MD14) | | D. R92/V26 | None | 55 | 61 | −15 | rank 4 |
| (CD14) | | Disp. B. 60 | None | 52 | −10 | −42 | rank 4 |
| (KD14) | | Solv. BK. 3 | None | 29 | 0 | −2 | rank 4 |
| (YD16) | (A16) | Disp. Y. 42 | None | 91 | −11 | −90 | rank 5 |
| (MD16) | | D. R92/V26 | None | 55 | 61 | −15 | rank 5 |
| (CD16) | | Disp. B. 60 | None | 52 | −10 | −42 | rank 5 |
| (KD16) | | Solv. BK. 3 | None | 31 | 0 | −2 | rank 5 |
| (YD18) | (A18) | Disp. Y. 42 | None | 90 | −12 | −89 | rank 2 |

TABLE 3-continued

| Toner | Resin | Colorant C.I. No. | Blocking | Chromaticity coordinates [CUEKAB1976] L* | a* | b* | resistance to plasticizer |
|---|---|---|---|---|---|---|---|
| (MD18) | | D. R92/V26 | None | 55 | 61 | −17 | rank 2 |
| (CD18) | | Disp. B. 60 | None | 53 | −10 | −39 | rank 2 |
| (KD18) | | Solv. BK. 3 | None | 29 | 0 | −2 | rank 2 |
| (YD19) | (A19) | Disp. Y. 42 | None | 94 | −10 | −63 | rank 1 |
| (MD19) | | D. R92/V26 | None | 65 | 42 | −12 | rank 1 |
| (CD19) | | Disp. B. 60 | None | 50 | 0 | −31 | rank 1 |
| (KD19) | | Solv. BK. 3 | None | 38 | −3 | 4 | rank 1 |
| (YD20) | (A20) | Disp. Y. 42 | None | 92 | −7 | −55 | rank 1 |
| (MD20) | | D. R92/V26 | None | 67 | 39 | −10 | rank 1 |
| (CD20) | | Disp. B. 60 | None | 53 | −4 | −28 | rank 1 |
| (KD20) | | Solv. BK. 3 | None | 41 | −2 | 4 | rank 1 |
| (YD21) | (A21) | Disp. Y. 42 | occured | 95 | −10 | −57 | rank 1 |
| (MD21) | | D. R92/V26 | occured | 66 | 45 | −12 | rank 1 |
| (CD21) | | Disp. B. 60 | occured | 59 | −5 | −23 | rank 1 |
| (KD21) | | Solv. BK. 3 | occured | 39 | −3 | 5 | rank 1 |

Disp. Y. 42: C.I. DISPERSE YELLOW 42
D. R92/V26: C.I. DISPERSE RED 92/C.I. DISPERSE VIOLET 26 = 2/1
Disp. B. 60: C.I. DISPERSE BLUE 60
Solv. BK. 3: C.I. DISPERSE BLACK 3

PREPARATION OF TONER 3

Disperse Dye/Wet Dyeing

Anthraquinone-type cyan dye (C.I. DISPERSE BLUE 87, 20 parts by weight), condensate of sodium naphthalenesulfonate with formalin (5 parts by weight), and deionized water (75 parts by weight) were subjected to fine dispersion by a sand mill to give a disperse dye (DDC)

In the same manner as in the above but using anthraquinone-type red dye (C.I. DISPERSE RED 92), anthraquinone-type violet dye (C.I. DISPERSE VIOLET 26), pyridone azo-type yellow dye (C.I. DISPERSE YELLOW 198), anthraquinone-type dark blue dye (C.I. DISPERSE BLUE 79), and Macrolex orange R (produced by Bayer), the disperse dyes shown in Table 4 were obtained.

TABLE 4

| Disperse Dye | Disperse Dye C.I. No. (trade name) |
|---|---|
| (DDC) | C.I. DISPERSE BLUE 87 |
| (DDR) | C.I. DISPERSE RED 92 |
| (DDV) | C.I. DISPERSE VIOLET 26 |
| (DDY) | C.I. DISPERSE YELLOW 198 |
| (DDB) | C.I. DISPERSE BLUE 79 |
| (DDO) | Macrolex Orange R (Bayer) |

Polyester resin (A02) was roughly pulverized by a chopper mill, and finely pulverized by an ultrasonic jet mill, followed by removal of particles having a diameter of not more than 5 μm and not less than 15 μm by dry classification. The obtained finely pulverized particles (100 parts by weight) were subjected to ultrasonic dispersion in 0.1% by weight of a condensate of sodium naphthalenesulfonate with formalin in deionized water (300 parts by weight) to give an aqueous dispersion of finely pulverized particles.

To the obtained aqueous dispersion of the finely pulverized particles was added 15 parts by weight of yellow disperse dye (DDY), and high temperature dyeing was performed at 130° C. for 1 hour using a dye tester (Minicolor, produced by Texam Giken). By dehydration using suction funnel, washing, and vacuum drying, the colored dry particles were obtained. The obtained finely pulverized particles (100 parts by weight) were mixed with 2 parts by weight of silica fine powder (trade name, Aerosil) by a Henschel mixer to give a yellow toner (YW02) having an average particle size of 9.2 μm.

In the same manner as in the above, the toners shown in Table 5 were obtained.

TABLE 5

| Toner | Resin | Colorant C.I. No. | Blocking | Chromaticity coordinates [CUEKAB1976] L* | a* | b* | resistance to plasticizer |
|---|---|---|---|---|---|---|---|
| (YW02) | (A02) | (DDY) | None | 90 | −13 | −91 | rank 5 |
| (MW02) | | (DDR/DDV) | None | 54 | 60 | −17 | rank 4 |
| (CW02) | | (DDC) | None | 52 | −10 | −42 | rank 4 |
| (KW02) | | (DDB/DDO) | None | 31 | 0 | −1 | rank 4 |
| (YW03) | (A03) | (DDY) | None | 90 | −12 | −90 | rank 5 |
| (MW03) | | (DDR/DDV) | None | 54 | 60 | −16 | rank 5 |
| (CW03) | | (DDC) | None | 54 | −12 | −39 | rank 4 |
| (KW03) | | (DDB/DDO) | None | 30 | 0 | −1 | rank 4 |
| (YW04) | (A04) | (DDY) | None | 90 | −13 | −93 | rank 5 |
| (MW04) | | (DDR/DDV) | None | 53 | 61 | −17 | rank 5 |
| (CW04) | | (DDC) | None | 52 | −10 | −42 | rank 5 |
| (KW04) | | (DDB/DDO) | None | 30 | 0 | −1 | rank 5 |
| (YW06) | (A06) | (DDY) | None | 90 | −13 | −93 | rank 5 |

TABLE 5-continued

| Experimental toner (dye, wet dyeing) evaluation results | | | | | | | |
|---|---|---|---|---|---|---|---|
| Toner | Resin | Colorant C.I. No. | Blocking | Chromaticity coordinates [CUEKAB1976] L* | a* | b* | resistance to plasticizer |
| (MW06) | | (DDR/DDV) | None | 54 | 61 | −17 | rank 5 |
| (CW06) | | (DDC) | None | 53 | −9 | −43 | rank 5 |
| (KW06) | | (DDB/DDO) | None | 29 | 0 | −1 | rank 5 |
| (YW08) | (A08) | (DDY) | None | 90 | −13 | −91 | rank 5 |
| (MW08) | | (DDR/DDV) | None | 55 | 61 | −17 | rank 4 |
| (CW08) | | (DDC) | None | 53 | −10 | −41 | rank 4 |
| (KW08) | | (DDB/DDO) | None | 29 | 0 | −1 | rank 4 |
| (YW09) | (A09) | (DDY) | None | 90 | −13 | −91 | rank 5 |
| (MW09) | | (DDR/DDV) | None | 55 | 61 | −17 | rank 5 |
| (CW09) | | (DDC) | None | 52 | −9 | −41 | rank 5 |
| (KW09) | | (DDB/DDO) | None | 29 | 0 | −1 | rank 4 |
| (YW12) | (A12) | (DDY) | None | 90 | −13 | −91 | rank 4 |
| (MW12) | | (DDR/DDV) | None | 55 | 61 | −17 | rank 4 |
| (CW12) | | (DDC) | None | 53 | −10 | −41 | rank 4 |
| (KW12) | | (DDB/DDO) | None | 30 | 0 | −1 | rank 4 |
| (YW17) | (A17) | (DDY) | None | 90 | −13 | −91 | rank 5 |
| (MW17) | | (DDR/DDV) | None | 55 | 61 | −17 | rank 5 |
| (CW17) | | (DDC) | None | 53 | −10 | −42 | rank 5 |
| (KW17) | | (DDB/DDO) | None | 30 | 0 | −1 | rank 5 |

PREPARATION OF TONER 4

Polyester Spherical Particles, Wet Dyeing

Polyester resin (A02, 340 parts by weight), methyl ethyl ketone (150 parts by weight), and tetrahydrofuran (140 parts by weight) were dissolved at 80° C., after which 680 parts by weight of water (80° C.) was added thereto to give an aqueous microdispersion of polyester resin having a particle size of about 0.1 μm. The obtained aqueous microdispersion was charged in a distillation flask, and distilled until the fraction temperature reached 100° C. After cooling, water was added to make the solid content 30% by weight.

In a 1 l four neck separable flask equipped with a thermometer, a condenser and a stirrer, 300 parts by weight of the aqueous microdispersion of polyester was charged, and the temperature was raised to 80° C. Thereafter, 40 parts by weight of an aqueous solution of 20% by weight of dimethylaminoethyl methacrylate was added over 60 minutes, followed by 300 minutes' stirring while keeping the temperature at 80° C. As a result, the conductivity in the system rose from about 1 mS to 25 mS, and pH fell from 10.8 to 6.7, thereby it was speculated that the added dimethylaminoethyl methacrylate had been completely hydrolyzed into a salt of dimethylaminoethanol and methacrylic acid. The polyester resin particles present in the aqueous microdispersion and having a particle size of submicron order agglomerated with time, grew into particles having an average particle size of 6.5 μm. The polyester spherical particles wherein the occupation percentage of the particles having particle sizes of 0.5D–2D when the average particle size is taken as D was 95% by weight were obtained. The thus-obtained polyester particles were filtered off, washed, and redispersed in water so that the solid content was 25% by weight.

To the aqueous dispersion (400 parts by weight) of the polyester spherical particles was added 15 parts by weight of yellow disperse dye (DDY), and high temperature dyeing was performed at 130° C. for 1 hour using a dye tester (Minicolor, produced by Texam Giken). By dehydration using suction funnel, washing, and vacuum drying, the colored dry particles were obtained. The obtained finely pulverized particles (100 parts by weight) were mixed with 2 parts by weight of silica fine powder (trade name, Aerosil) by a Henschel mixer to give yellow toner (YW02) having an average particle size of 6.5 μm.

In the same manner as in the above, the toners shown in Table 6 were obtained.

TABLE 6

| Experimental toner (polyester spherical particles, wet dyeing; and polyester spherical particles containing pigment) evaluation results | | | | | | | |
|---|---|---|---|---|---|---|---|
| Toner | Resin | Colorant C.I. No. | Blocking | Chromaticity coordinates [CUEKAB1976] L* | a* | b* | resistance to plasticizer |
| (YB02) | (A02) | (DDY) | None | 91 | −13 | −91 | rank 5 |
| (MB02) | | (DDR/DDV) | None | 54 | 59 | −17 | rank 4 |
| (CB02) | | (DDC) | None | 52 | −11 | −40 | rank 5 |
| (KB02) | | (DDB/DDO) | None | 31 | 0 | 0 | rank 4 |
| (YB03) | (A03) | (DDY) | None | 90 | −11 | −91 | rank 5 |
| (MB03) | | (DDR/DDV) | None | 54 | 60 | −16 | rank 5 |
| (CB03) | | (DDC) | None | 54 | −12 | −40 | rank 4 |
| (KB03) | | (DDB/DDO) | None | 31 | 0 | −1 | rank 4 |
| (YB04) | (A04) | (DDY) | None | 91 | −13 | −93 | rank 5 |
| (MB04) | | (DDR/DDV) | None | 54 | 60 | −17 | rank 4 |
| (CB04) | | (DDC) | None | 52 | −10 | −42 | rank 5 |
| (KB04) | | (DDB/DDO) | None | 29 | 0 | −1 | rank 5 |
| (YB06) | (A06) | (DDY) | None | 90 | −13 | −93 | rank 5 |
| (MB06) | | (DDR/DDV) | None | 54 | 61 | −17 | rank 5 |

TABLE 6-continued

| Experimental toner (polyester spherical particles, wet dyeing; and polyester spherical particles containing pigment) evaluation results | | | | | | | |
|---|---|---|---|---|---|---|---|
| | | | | Chromaticity coordinates [CUEKAB1976] | | | |
| Toner | Resin | Colorant C.I. No. | Blocking | L* | a* | b* | resistance to plasticizer |
| (CB06) | | (DDC) | None | 53 | −9 | −43 | rank 5 |
| (KB06) | | (DDB/DDO) | None | 29 | 0 | −1 | rank 4 |
| (YB08) | (A08) | (DDY) | None | 90 | −13 | −91 | rank 5 |
| (MB08) | | (DDR/DDV) | None | 55 | 61 | −17 | rank 4 |
| (CB08) | | (DDC) | None | 53 | −10 | −41 | rank 5 |
| (KB08) | | (DDB/DDO) | None | 29 | 0 | 0 | rank 4 |
| (YB09) | (A09) | (DDY) | None | 90 | −13 | −91 | rank 5 |
| (MB09) | | (DDR/DDV) | None | 55 | 61 | −17 | rank 5 |
| (CB09) | | (DDC) | None | 52 | −9 | −41 | rank 5 |
| (KB09) | | (DDB/DDO) | None | 29 | 0 | −1 | rank 4 |
| (YB12) | (A12) | (DDY) | None | 90 | −13 | −91 | rank 4 |
| (MB12) | | (DDR/DDV) | None | 55 | 62 | −18 | rank 5 |
| (CB12) | | (DDC) | None | 53 | −10 | −41 | rank 4 |
| (KB12) | | (DDB/DDO) | None | 31 | 0 | −1 | rank 4 |
| (YB17) | (A17) | (DDY) | None | 90 | −13 | −91 | rank 5 |
| (MB17) | | (DDR/DDV) | None | 54 | 60 | −16 | rank 5 |
| (CB17) | | (DDC) | None | 53 | −10 | −42 | rank 5 |
| (KB17) | | (DDB/DDO) | None | 30 | 0 | 0 | rank 4 |
| (KC02) | (A02) | carbon black | None | 30 | 0 | 0 | rank 5 |

PREPARATION OF TONER 5

Polyester Spherical Particles Containing Pigment

PRINTEX 150T (produced by Degussa, 100 parts by weight) as a carbon black, a thymol dispersant, Mignol 802 (produced by Ippousha Yushi Kogyo, Japan, 50 parts by weight), and deionized water (850 parts by weight) were charged in a sand mill, and dispersed for 120 minutes to give an aqueous dispersion of the carbon black.

Polyester resin (A02, 340 parts by weight), methyl ethyl ketone (150 parts by weight), and tetrahydrofuran (140 parts by weight) were dissolved at 80° C., and thereto was added 680 parts by weight of water (80° C.) to give an aqueous microdispersion of a copolymerized polyester copolymer having a particle size of about 0.1 μm. The obtained aqueous microdispersion was charged in a distillation flask, and distilled until the fraction temperature reached 100° C. After cooling, water was added to make the solid content 30% by weight.

In a 5 l four neck separable flask equipped with a thermometer, a condenser and a stirrer, 980 parts by weight of the polyester aqueous microdispersion, 200 parts by weight of a carbon black aqueous dispersion, and 24 parts by weight of dimethylaminoethyl (2,2-dimethylol)propionate as an electrolyte precursor were charged, and the water bath temperature was raised to 80° C., followed by 240 minutes' stirring while keeping the temperature at 80° C. As a result, 98% or more of the dimethylaminoethyl (2,2-dimethylol)propionate was hydrolyzed into dimethylaminoethanol and 2,2-dimethylol propionic acid. The microdispersed particles present in the polyester aqueous microdispersion grew by incorporating the carbon black particles. As a result, there were produced polyester particles having an average particle size, D, of 5.9 μm the occupation percentage (by weight) of the particles having 0.5D–2D, of 100%, and the occupation percentage (by number) of the particles having a sphereness of 0.7 or above of 99%. The thus-obtained polyester particles were subjected to dehydration, filtering off, and spray drying to give dry particles. With 100 parts by weight of the, obtained particles was mixed 2 parts by weight of silica fine powder (trade name, Aerosil) by a Henschel mixer to give a black toner (KC02) shown in Table 6.

The toners prepared as described were evaluated for the following characteristics.

STORAGE STABILITY

Blocking Test

The toner obtained was allowed to stand at 50μ C. and 50% RH for 24 hours, and storage stability was evaluated according to the presence or absence of blocking, the results of which are shown in Tables 2, 3, 5 and 6. It is clear from the results that the toners comprising a polyester resin having a glass transition temperature of 58° C. or more are superior in storage stability.

FIXABILITY

A toner (5 parts by weight) and ferrite carrier F-100 (produced by Powdertech, 95 parts by weight) were mixed and stirred by a ball mill to give a two-component system developing agent. Using the obtained two-component system developing agent, a 7 cm square solid pattern was formed on a sheet of paper by an electrophotographic copier, and the paper was used as a test piece. The average thickness of the toner layer on the paper was standardized to about 10 μm. All the toner layer surfaces after fixing showed fine gloss, proving superior fixability of the polyester resin.

IMAGE EVALUATION

Using the aforementioned copier, a full color continuous gradation image was copied to evaluate the copied image. Superior gradation reproduction and high resolution of 400 DPI or more were obtained using each toner.

COLOR EVALUATION

The chromaticity coordinates of the test piece obtained in the fixing test was determined by chromoscope CR-210 (produced by Minolta), the results of which are summarized in Tables 2, 3, 5 and 6. When a dye was used as a coloring agent, the use of polyester resins (A19)-(A21) as a binder resin evidently caused lowering of chroma.

RESISTANCE TO PLASTICIZER

A 2 cm square was cut out from a soft transparent vinyl chloride sheet containing dioctyl phthalate as a plasticizer, and placed in the center of the test piece obtained in the fixing test. A load of 500 g/cm$^2$ was applied on the square, and the square was allowed to stand at 50° C. and 50% RH for 24 hours, after which the vinyl chloride sheet was peeled off from the test piece, and evaluation of the surface was performed according to the standard of Table 7. The results are shown in Tables 2, 3, 5 and 6. It is evident that the toner comprising a polyester resin having a specific gravity of 1.3 or above is superior in resistance to plasticizer.

TABLE 7

| Rank | Plasticization of toner layer | Adhesion between toner layer and vinyl chloride sheet | Transfer of colorant to vinyl chloride sheet |
|---|---|---|---|
| 5 | none | none | none |
| 4 | none | a little adhesion | none |
| 3 | none | a little adhesion | occurred |
| 2 | undeterminable | almost adhered | occurred |
| 1 | none | adhered | occurred |

As has been described, the toner for electrophotography of the present invention shows high resistance to plasticizer, and is superior in storage stability, low temperature fixing, transparency, processability, color fastness to heat and color fastness to light.

What is claimed is:

1. A toner for electrophotography which comprises, as a binder resin, a polyester resin obtained from carboxylic acids containing aromatic monomer in a proportion of 80 mol % or more relative to the entire carboxylic acid component, and alcohols containing aliphatic diols having 2 to 4 carbon atoms in a proportion of 70-100 mol % relative to the entire alcohol component and alicyclic alcohols in a proportion of 0-30 mol % relative to the entire alcohol component, and having a specific gravity of 1.3 or more, a glass transition temperature of 58° C. or more, and a number average molecular weight of 1,000-6,000.

2. A toner for electrophotography which comprises, as a binder resin, the polyester resin of claim 1 containing, as the aliphatic diols having 2 to 4 carbon atoms, ethylene glycol in a proportion of 0-90 mol % relative to the entire alcohol component, and propylene glycol in a proportion of 10-100 mol % relative to the entire alcohol component.

3. A toner for electrophotography which comprises, as a binder resin, the polyester resin of claim 1 containing, as the aliphatic diols having 2 to 4 carbon atoms, 2,3-butanediol in a proportion of 5-80 mol % relative to the entire alcohol component, and ethylene glycol in a proportion of 20-95 mol % relative to the entire alcohol component.

4. A toner for electrophotography which comprises, as a binder resin, the polyester resin of claim 1 containing aliphatic diols having 2 to 4 carbon atoms in a proportion of 70-95 mol % relative to the entire alcohol component, and as the alicyclic alcohols, alcohols having tricyclodecane skeleton in a proportion of 5-30 mol % relative to the entire alcohol component.

5. A toner for electrophotography which comprises, as a binder resin, the polyester resin of claim 4 wherein the alcohol having tricyclodecane skeleton is selected from the group consisting of tricyclodecyl methanol and tricyclodecane dimethanol.

6. A toner for electrophotography which comprises, as a binder resin, the polyester resin of claim 1 containing aliphatic diols having 2 to 4 carbon atoms in a proportion of 70-95 mol % relative to the entire alcohol component, and as the alicyclic alcohols, alcohols having cyclohexane skeleton in a proportion of 5-30 mol % relative to the entire alcohol component.

7. A toner for electrophotography which comprises, as a binder resin, the polyester resin of claim 5 wherein the alcohol having cyclohexane skeleton is selected from the group consisting of cyclohexanediol, hydrogenated biphenol and hydrogenated bisphenol A.

8. A toner for electrophotography which comprises, as a binder resin, the polyester resin of claim 1 wherein the aromatic monomer is terephthalic acid and/or isophthalic acid and/or orthophthalic acid.

9. A toner for electrophotography which comprises, as a binder resin, the polyester resin of claim 1 containing, as the aromatic monomer, carboxylic acids having naphthalene skeleton in a proportion of 1-20 mol % relative to the entire carboxylic acid component.

10. A toner for electrophotography which comprises, as a binder resin, the polyester resin of claim 1 containing, as the aromatic monomer, at least one member of the group consisting of trimellitic acid, trimesic acid and pyromellitic acid in a proportion of 2-8 mol % relative to the entire carboxylic acid component.

11. A toner for electrophotography which comprises, as a binder resin, the polyester resin of claim 1 containing, as the aromatic monomer, carboxylic acid having a sulfonic acid metal salt group and/or a sulfonic acid ammonium salt group in a proportion of not more than 6.0 mol % relative to the entire carboxylic acid component.

12. A toner for electrophotography which comprises, as a binder resin, the polyester resin of claim 1 containing, as the aromatic monomer, benzoic acid having a branched alkyl as a substituent in a proportion of 5-20 mol % relative to the entire carboxylic acid component.

13. A toner for electrophotography which comprises, as a binder resin, the polyester resin of claim 1 having a melt viscosity at 130° C. of 1,500-40,000 poise.

14. A toner for electrophotography which comprises, as a binder resin, the polyester resin of claim 1 having a run-off initiation temperature of 80°-130° C.

15. A toner for electrophotography which comprises, as a binder resin, the polyester resin of claim 1, wherein an average particle size, D, is 1-30 μm, and at least 80% by weight of the entire particles have 0.5-2.0 D, and at least 80% (number) of the entire particles have a sphereness (ratio of shorter diameter to longer diameter) of 0.7 or more.

* * * * *

UNITED STATES PATENT AND TRADEMARK OFFICE

CERTIFICATE OF CORRECTION

PATENT NO. : 5,324,612

DATED : JUNE 28, 1994

INVENTOR(S) : SATOSHI MAEDA, YASUNARI HOTTA, MINAKO ARICHI, YOHZO YAMADA, TETSUO SHIMOMURA AND YOSHIHIRO IKUZAWA

It is certified that error appears in the above-identified patent and that said Letters Patent is hereby corrected as shown below:

Column 8, line 35, delete "1 $\kappa$" and substitute therefor -- $1/\kappa$ --;

Column 16, Table 2, line 4 of the heading, delete "[CUEKAB1976]" and substitute therefor -- [CIELAB1976] --;

Column 16, Table 2, "MP17" under heading of "a*", delete "62" and substitute therefor -- 60 --;

Column 17, Table 2 - continued, line 4 of the heading, delete "[CUEKAB1976]" and substitute therefor -- [CIELAB1976] --;

Column 18, Table 3, line 4 of the heading, delete "[CUEKAB1976]" and substitute therefor -- [CIELAB1976] --;

Column 19, Table 3 - continued, line 4 of the heading, delete "[CUEKAB1976]" and substitute therefor -- [CIELAB1976] --;

Column 20, Table 5, delete heading "Colorant C.I. No." and substitute therefor -- Disperse Dye --;

UNITED STATES PATENT AND TRADEMARK OFFICE

CERTIFICATE OF CORRECTION

PATENT NO. : 5,324,612

DATED : JUNE 28, 1994

INVENTOR(S) : SATOSHI MAEDA, YASUNARI HOTTA, MINAKO ARICHI, YOHZO YAMADA, TETSUO SHIMOMURA AND YOSHIHIRO IKUZAWA

It is certified that error appears in the above-identified patent and that said Letters Patent is hereby corrected as shown below:

Column 20, Table 5, line 4 of the heading, delete "[CUEKAB1976]" and substitute therefor -- [CIELAB1976] --;

Column 21, Table 5 - continued, delete heading "Colorant C.I. No." and substitute therefor -- Disperse Dye --;

Column 21, Table 5 - continued, line 4 of the heading, delete "[CUEKAB1976]" and substitute therefor -- [CIELAB1976] --;

Column 21, Table 5 - continued, "KW08" under heading of "b*", delete "-1" and substitute therefor -- 0 --;

Column 21, Table 5 - continued, "KW09" under heading of "b*", delete "-1" and substitute therefor -- 0 --;

Column 21, Table 5 - continued, "KW17" under heading of "b*", delete "-1" and substitute therefor -- 0 --;

Column 22, Table 6, delete heading "Colorant C.I. No." and substitute therefor -- Disperse Dye --;

UNITED STATES PATENT AND TRADEMARK OFFICE

CERTIFICATE OF CORRECTION

PATENT NO. : 5,324,612

DATED : JUNE 28, 1994

INVENTOR(S) : SATOSHI MAEDA, YASUNARI HOTTA, MINAKO ARICHI, YOHZO YAMADA, TETSUO SHIMOMURA AND YOSHIHIRO IKUZAWA

It is certified that error appears in the above-identified patent and that said Letters Patent is hereby corrected as shown below:

Column 22, Table 6, line 6 of the heading, delete "[CUEKAB1976]" and substitute therefor -- [CIELAB1976] --;

Column 23, Table 6 - continued, delete heading "Colorant C.I. No." and substitute therefor -- Disperse Dye --;

Column 23, Table 6 - continued, line 6 of the heading, delete "[CUEKAB1976]" and substitute therefor -- [CIELAB1976] --; and Column 24, line 35, delete "50$\mu$C." and substitute therefor -- 50°C.--.

Signed and Sealed this

Fourth Day of April, 1995

Bruce Lehman

*Attest:*

BRUCE LEHMAN

*Attesting Officer*

*Commissioner of Patents and Trademarks*